US006863117B2

(12) United States Patent
Valenzuela

(10) Patent No.: US 6,863,117 B2
(45) Date of Patent: Mar. 8, 2005

(54) CAPILLARY EVAPORATOR

(75) Inventor: Javier A. Valenzuela, Claremont, NH (US)

(73) Assignee: Mikros Manufacturing, Inc., Claremont, NH (US)

( * ) Notice: Subject to any disclaimer, the term of this patent is extended or adjusted under 35 U.S.C. 154(b) by 9 days.

(21) Appl. No.: 10/374,933

(22) Filed: Feb. 26, 2003

(65) Prior Publication Data

US 2003/0159809 A1 Aug. 28, 2003

Related U.S. Application Data

(60) Provisional application No. 60/359,673, filed on Feb. 26, 2002.

(51) Int. Cl.[7] ..... F28D 15/00

(52) U.S. Cl. ..... 165/104.26; 165/104.21; 165/104.33

(58) Field of Search ..... 29/890.032; 165/104.21, 165/104.26, 104.22, 104.33, 907; 122/366; 361/699, 700; 257/714, 715; 174/15.2

(56) References Cited

U.S. PATENT DOCUMENTS

| | | | | | |
|---|---|---|---|---|---|
| 3,525,670 | A | * | 8/1970 | Brown | 376/329 |
| 3,857,441 | A | * | 12/1974 | Arcella | 165/104.26 |
| 4,515,209 | A | | 5/1985 | Maidanik et al. | 165/104.22 |
| 4,903,761 | A | * | 2/1990 | Cima | 165/104.25 |
| 5,761,037 | A | * | 6/1998 | Anderson et al. | 361/700 |
| 5,944,092 | A | * | 8/1999 | Van Oost | 165/104.26 |
| 6,227,288 | B1 | | 5/2001 | Gluck et al. | 165/104.26 |
| 6,241,008 | B1 | | 6/2001 | Dunbar | 165/104.26 |
| 6,293,333 | B1 | | 9/2001 | Ponnappan et al. | 165/104.26 |
| 6,330,907 | B1 | | 12/2001 | Ogushi et al. | 165/104.26 |
| 6,388,882 | B1 | * | 5/2002 | Hoover et al. | 361/704 |
| 6,446,706 | B1 | * | 9/2002 | Rosenfeld et al. | 165/46 |
| 6,450,132 | B1 | * | 9/2002 | Yao et al. | 122/366 |
| 6,460,612 | B1 | * | 10/2002 | Sehmbey et al. | 165/96 |
| 6,648,063 | B1 | * | 11/2003 | Andraka et al. | 165/104.26 |

OTHER PUBLICATIONS

Loop Heat–Pipe Evaporator with Bidisperse Wick Structures; by John H. Rosenfled, David B. Sarraf, Dimitry K. Khrustalev, Peter J. Wellen and Mark T. North of Thermacore, Inc. for Goddard Space Flight Center; http://www.nasatech.com/Briefs/Nov99/GSC14225.html; Nov. 1999.

* cited by examiner

*Primary Examiner*—Tho V Duong
(74) *Attorney, Agent, or Firm*—Bowditch & Dewey, LLP

(57) ABSTRACT

A capillary evaporator (100) for removing heat from a heat source (102), particularly under high heat-flux conditions. The capillary evaporator includes a housing (104) having a plurality of ribs (108) in thermal communication with the heat source when the heat source is present. The ribs define a plurality of vapor channels (110) for receiving vapor (112) caused by the vaporization of working fluid (114) within the evaporator. A capillary wick (106) is located within the housing in spaced relation to the ribs. A bridge (118) interposed between the capillary wick and ribs thermally communicates heat from the ribs to the wick and fluidly communicates the vapor from the wick to the vapor channels. The bridge includes a plurality of fractal layers (FL) each having openings (122) and webs (128) that are scaled in size and number with respect to the immediately adjacent fractal layer and are arranged so that the openings in adjacent layers overlap one another.

34 Claims, 12 Drawing Sheets

CAPILLARY EVAPORATOR

CROSS-REFERENCE TO RELATED APPLICATION

This application claims the benefit of priority of U.S. Provisional Patent Application No. 60/359,673, filed Feb. 26, 2002 and entitled "Fractal Capillary Evaporator."

FIELD OF THE INVENTION

The present invention relates generally to the field of thermal management systems. More particularly, the present invention is directed to a capillary evaporator.

BACKGROUND OF THE INVENTION

Capillary evaporators are used in a variety of two-phase thermal management systems. The primary difference between capillary evaporators and flow-through and kettle boilers is that nucleate boiling does not occur in evaporators, whereas it does in boilers. Instead, evaporation takes place in a capillary evaporator at a liquid-vapor interface held stable by a capillary wick structure. The liquid supplied to an evaporator is at a pressure lower than the vapor pressure, and the liquid is drawn into the evaporator by the capillary suction of the wick.

A common capillary evaporator configuration is the configuration used in heat pipes. A conventional heat pipe typically consists of a tube containing a porous capillary wick layer in contact with the inner surface of the tube. One portion of the heat pipe, typically one end, absorbs heat from a heat source and functions as an evaporator. Another portion, typically the other end, rejects heat to a heat sink and functions as a condenser. The capillary wick returns the liquid from the condenser portion to the evaporator portion of the heat pipe via the capillary pumping action of the wick. The inner surface of the wick defines a central passageway that conducts vapor from the evaporator portion to the condenser portion of the heat pipe. The capillary wick can be any of a variety of structures, such as machined grooves, a discrete metal screen, sintered metal powder, or a plasma-deposited porous coating. Heat pipes are economical to fabricate and work well in applications with modest heat fluxes and relatively short heat transport distances. Many contemporary high-performance laptop computers use heat pipes to remove heat from the processor and transfer it to the case.

Within a heat pipe, the liquid has to flow a substantial distance from the condenser portion to the evaporator portion through the capillary wick. This creates a large pressure drop for the liquid that effectively limits the maximum liquid flow rate, thereby limiting the heat transport capacity of the heat pipe. If the pore size of the wick is decreased to provide higher capillary suction, the permeability of the wick decreases and the pressure drop increases. Increasing the thickness of the wick reduces the pressure drop, but increases the distance the heat must be conducted through the wick at the evaporator portion of the heat pipe. Increasing the thickness of the wick translates into a higher thermal resistance at the evaporator and, perhaps more limiting, an increase in the liquid superheat at the interface between the inner surface of the tube and the wick. Eventually, the superheat at the base of the wick becomes too large and boiling takes place in the wick, leading to a drying out of the wick. When the wick dries out, the performance of the wick degrades substantially.

Many applications, including spacecraft thermal management systems, need higher heat transport capacity over longer distances than afforded by conventional heat pipes. For these applications, the basic heat pipe is typically enhanced by returning the liquid from the condenser portion to the evaporator portion in a separate tube that does not have an internal wick. Because this return flow does not suffer the large pressure drop of flow through a wick, the distance between the evaporator and condenser can be substantially increased. Also, the capillary wick within the evaporator is moved away from the heat-acquisition interface, typically by providing ribs that additionally define vapor passageways between the wick and heat-acquisition interface. These modifications lead to two types of heat-transfer systems, namely, the loop heat pipe (LHP) and capillary pumped loop (CPL). CPLs and LHPs are increasingly being employed in spacecraft thermal management systems, and their operating characteristics, both on earth and in microgravity, have been studied extensively.

FIG. 1A shows an exemplary conventional evaporator suitable for use in either an LHP or CPL. Evaporator 20 includes a tubular housing 22 and a like-shaped capillary wick 24 located within the housing. Capillary wick 24 defines a central passageway 26 for conducting a liquid 28 along the length of the wick. Housing 22 is typically made of a highly conductive metal and includes a plurality of ribs 30. Ribs 30 serve the dual purposes of: (1) defining a plurality of vapor passageways, or channels 32, for conducting vapor 34 formed by vaporizing liquid 28 away from capillary wick 24 and (2) conducting heat from the outer portion of housing 22 to the capillary wick to transfer the heat to the liquid, thereby causing the liquid to vaporize.

The primary differences between conventional evaporators of CPLs and LHPs, such as evaporator 20, and the evaporator portions of conventional heat pipes are that in the LHP/CPL type evaporators the liquid supply is substantially thermally isolated from the heat source, e.g., by capillary wick 24, and the liquid flow through the capillary wick is normal to the heat acquisition interface and, hence, the flow area is much larger and the flow length much shorter than in the "wall-wick" evaporator portion of a heat pipe. These differences result in substantially higher heat transport capacity for LHPs and CPLs than for heat pipes. However, the higher heat transport capacity in LHP/CPL type evaporators comes at a price, namely, a substantially degraded thermal connection between heat source 36 and capillary wick 24 caused by the non-continuous contact of housing 22 with the wick via ribs 30, which are typically made of metal.

The design of metal ribs 30 must meet the conflicting requirements of minimizing the thermal resistance between housing 22 and capillary wick 24, while at the same time minimizing the vapor pressure drop within evaporator 20. As shown in FIG. 1B, the presence of ribs 30 distorts the heat transfer and fluid flow in capillary wick 24 because they create hot zones within the wick. At low heat fluxes, capillary wick 24 is completely wetted and evaporation takes place only in regions 33 immediately surrounding the edges of the ribs 30 where the ribs contact the wick. The magnitude of heat transfer is limited by the perimeter length of the ribs that contact the wick. The total area of evaporation regions 33 in capillary wick 24 is therefore small and, hence, the evaporation resistance much increased. Additionally, instead of flowing uniformly through capillary wick 24, liquid 28 must now converge into narrow regions along ribs 30, greatly increasing the pressure drop in the wick.

FIG. 1C shows conditions that exist within the wick at large values of heat flux. At higher heat fluxes, the liquid-vapor interface 40 recedes into capillary wick 24, providing a larger area for evaporation. As liquid-vapor interface 40 recedes, the thermal resistance of evaporator 20 increases because of the relatively low thermal conductivity of capillary wick 24. Perhaps more importantly, as liquid-vapor interface 40 recedes, the overall pressure drop increases sharply because vapor 34 must now flow some distance through the small pores of capillary wick 24 before reaching vapor channels 32. Eventually, the pressure drop in vapor 34 exceeds the capillary pumping capacity of capillary wick 24 and the vapor breaks through to central passageway 26, i.e., the liquid side of evaporator 20. This "vapor blow-by" condition sets a heat flux limit on evaporator performance.

To mitigate these effects, conventional LHP-type evaporators typically have metal capillary wicks instead of ceramic, glass, or polymer wicks to provide the wicks with a relatively high thermal conductivity. Higher thermal conductivity more effectively spreads heat into the wick, increasing the area over which evaporation takes place, thereby reducing thermal resistance. However, higher thermally conductive wicks increase the leakage of heat through the wick to liquid 28 at the other side of the wick. This can cause boiling of liquid 28 in the central passageway 26 thereby blocking the flow of liquid 28 to the evaporator and limiting the maximum heat flux. Increasing the thickness of the wicks will somewhat mitigate this heat leakage but will, in turn, decrease their permeability and, thus, also reduce the maximum heat flux of such evaporators.

It is anticipated that thermal management of future high-power laser instrumentation, next- and future-generation microprocessor chips, and other electronics, among other devices, will require power dissipation in the range of 2–5 kW at heat fluxes greater than 100 W/cm$^2$ The ITANIUM® microprocessor from Intel Corporation, Santa Clara, Calif. is already reaching local heat fluxes of about 300 W/cm$^2$. In contrast, most conventional evaporators, such as evaporator 20 discussed above, typically do not work at heat-fluxes in excess of about 12 W/cm$^2$ because vapor blanketing in the capillary wicks blocks the flow of liquid into the wicks. Although some more recent evaporator designs, such as the bidispersed wick design, have demonstrated good performance at localized heat fluxes of 100 W/cm$^2$, there is, and will continue to be, a need for evaporators capable of routinely handling average heat fluxes of 100 W/cm$^2$ and greater.

SUMMARY OF THE INVENTION

In a first aspect, the present invention is directed to a capillary evaporator comprising at least one first rib defining at least one first channel. A capillary wick confronts, and is spaced from, the at least one first rib. A first bridge is located between the at least one first rib and the capillary wick and provides fluid communication between the capillary wick and the at least one first channel and thermal communication between the capillary wick and the at least one rib. The first bridge includes internal features having sizes that decrease in a direction from the at least one first rib to the capillary wick.

In another aspect, the present invention is directed to a capillary evaporator comprising a capillary wick having a first face and a second face spaced from the first face. A first bridge confronts the first face of the capillary wick and has a plurality of first internal passageways each having a first cross-sectional area. The plurality of first internal passageways become less numerous in a direction away from the capillary wick and the first cross-sectional areas of the plurality of first internal passageways become larger in a direction away from the capillary wick. A second bridge confronts the second face of the capillary wick and has a plurality of second internal passageways each having a second cross-sectional area, wherein the plurality of second internal passageways become less numerous in a direction away from the capillary wick and the second cross-sectional areas of the plurality of second internal passageways become larger in a direction away from the capillary wick.

BRIEF DESCRIPTION OF THE DRAWINGS

For the purpose of illustrating the invention, the drawings show a form of the invention that is presently preferred. However, it should be understood that the present invention is not limited to the precise arrangements and instrumentalities shown in the drawings, wherein.

DETAILED DESCRIPTION OF THE DRAWINGS

Figure 2:
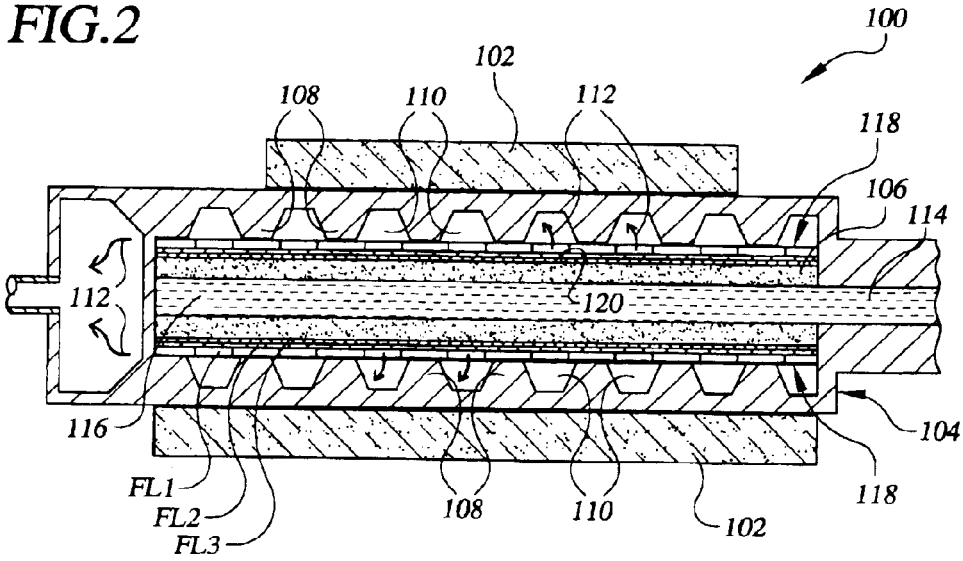
FIG. 2 is a cross-sectional view of a capillary evaporator of the present invention.

Referring now to the drawings, FIG. 2 shows, in accordance with the present invention, a capillary evaporator, which is identified generally by the numeral 100. Like evaporator 20 discussed in the background section, above, capillary evaporator 100 may be incorporated into a two-phase heat-transfer system, such as the loop heat pipe (LHP) and capillary pumped loop (CPL) systems mentioned above, among others. Capillary evaporator 100 may be any size and/or shape suitable for interfacing with any of a variety of heat sources, such as heat source 102, that is desired to be cooled. Those skilled in the art will appreciate the variety of shapes and/or sizes of capillary evaporator 100 that may be made in accordance with the present invention and that the various capillary evaporators shown and described in the present application are generally provided only to illustrate the various aspects of the present invention and not to limit the scope of the invention, as defined by the claims appended hereto.

Due to its unique structure, which is described below in detail, capillary evaporator 100 of the present invention can be provided with the ability to handle large heat fluxes, e.g., 100 W/cm$^2$ to 1,000 W/cm$^2$ and greater, that are significantly higher than the maximum heat fluxes that conventional capillary wick type evaporators can handle. Therefore, capillary evaporator 100 can be an important component of heat-management systems for heat sources 102 having high heat fluxes, such as lasers, microprocessors, and other high-power electronic devices, among others, in both gravity and micro-gravity applications. Those skilled in the art will appreciate the variety of applications for which capillary evaporator 100 of the present invention may be adapted.

Similar to evaporator 20 described in the background section above, capillary evaporator 100 may comprise a housing 104 and a capillary wick 106 located within the housing. Housing 104 may be made of a material having a relatively high thermal conductivity, such as a metal, e.g., copper or aluminum, among others, or other high thermally conductive material, to conduct heat from heat source 102 toward capillary wick 106. Housing 104 may include a plurality of ribs 108 that define one or more vapor passageways, or channels 110, for conducting away from capillary wick 106 vapor 112 formed by the vaporization of a working liquid 114 at the wick due to the heat from heat source 102.

As used herein and in the appended claims, the plural term "ribs" includes the case wherein a single rib, e.g., a single spiral rib or a single meandering rib, is present, but a linear cross-section reveals that such single rib is "cut" at a plurality of locations along its length to give the illusion that a plurality of ribs is present. The term "ribs" also includes any structure that defines either of the lateral sides of a channel, whether or not a second channel is located on the other side of that structure. For example, the portions of a solid block of material that define the lateral sides of a sole channel formed in the block are considered ribs for the purposes of the present invention.

Capillary wick 106 may be made of any suitable material having capillary passageways for conducting working liquid 114 therethrough. For example, capillary wick 106 may be made of a material having a relatively low thermal conductivity, such as a ceramic, glass, or polymer, among others, or a material having a relatively high thermal conductivity, such as metal, among others. Such materials may be formed into capillary wick 106 by any known means, such as casting, sintering, micro-machining, and etching, among others. In addition to conventional wick structures, capillary wick 106 may also comprise one or more micro-porous fractal layers (not shown) similar to the fractal layers FL described below. Those skilled in the art will appreciate the variety of materials and structures that may be used for capillary wick 106. Capillary wick 106 may define a central passageway 116 for conducting liquid 114 along the length of the wick to distribute the liquid to the wick. Working liquid 114 may be any suitable liquid capable of providing capillary evaporator 100 with two-phase (liquid/vapor) operation under the conditions for which the capillary evaporator is designed to operate. Examples of liquids suitable for working liquid 114 include water, ammonia, alcohols, and refrigerants, such as R-134 fluorocarbon, among others.

Unlike evaporator 20, however, capillary evaporator 100 of the present invention includes a "thermal bridge," such as vapor-side bridge 118, interposed between ribs 108 and capillary wick 106. Generally, vapor-side bridge 118 functions as a heat spreader to spread heat from ribs 108 substantially uniformly across the outer surface 120 of capillary wick 106 and as a vapor collection manifold to conduct vapor 112 formed at the outer surface of the capillary wick to vapor passageways 110.

Figure 3:
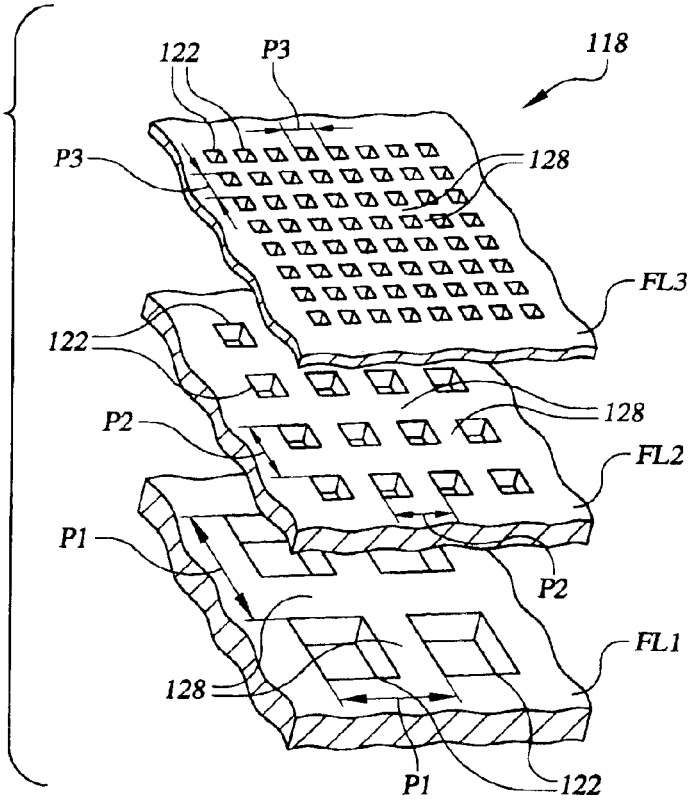
FIG. 3 is a perspective exploded view of a portion of the vapor-side bridge of the capillary evaporator of FIG. 2.
Figure 4:
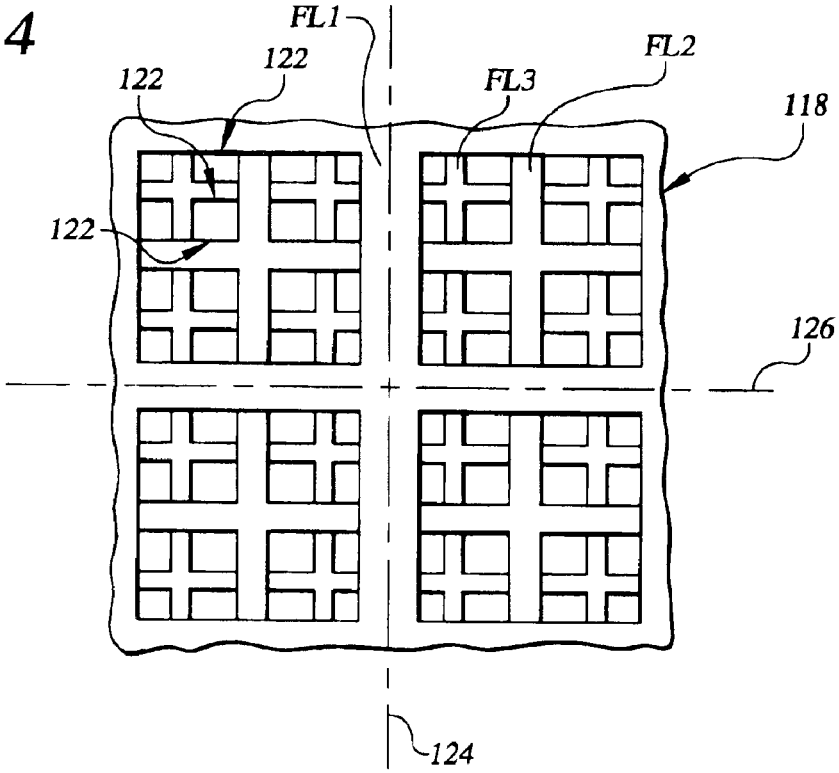
FIG. 4 is an enlarged partial plan view of the vapor-side bridge of FIG. 3.
Figure 5A:
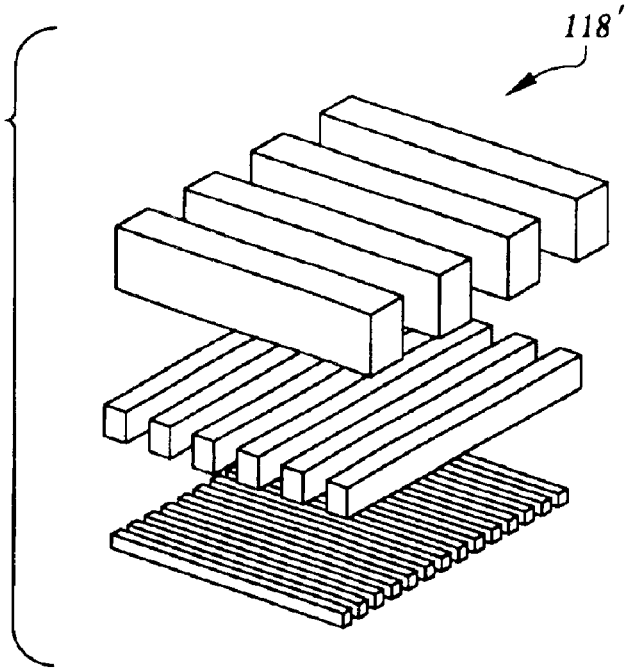
FIGS. 5A–5D are each a perspective exploded view of an alternative embodiment of the vapor-side bridge of the capillary evaporator of FIG. 2.
Figure 5B:
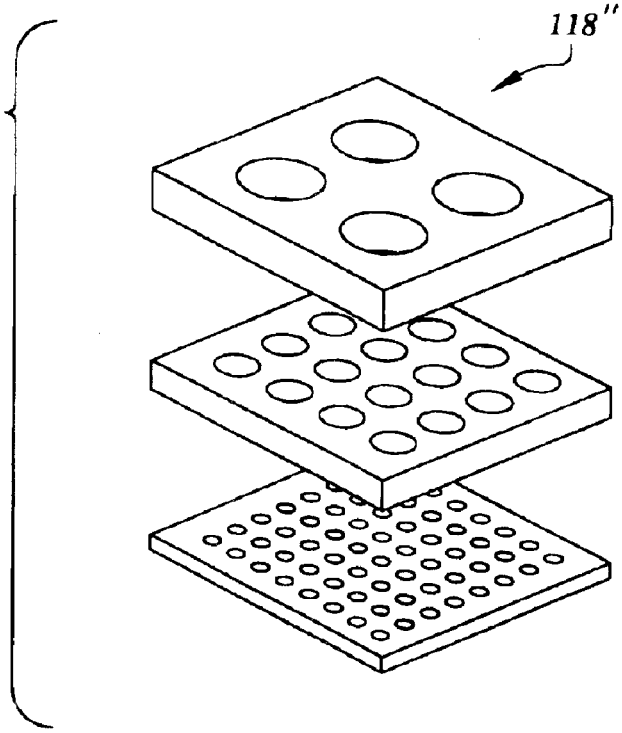
Figure 5C:
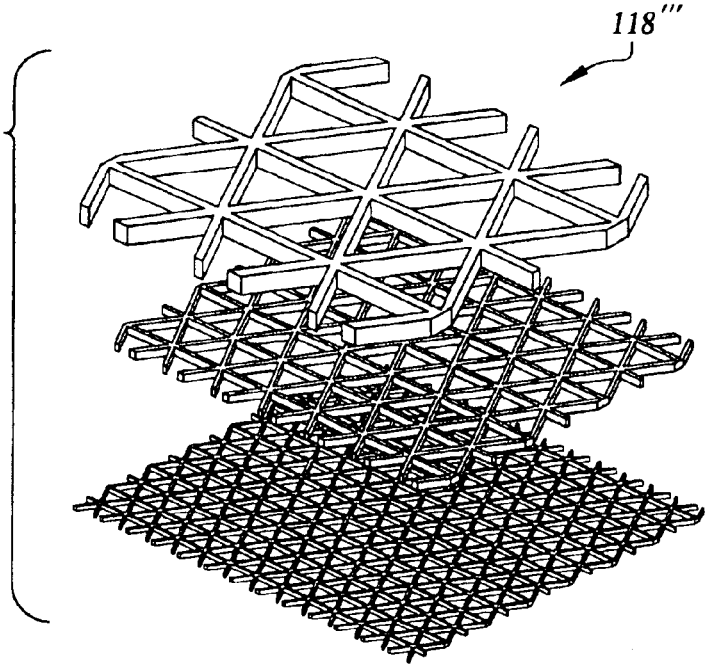
Figure 5D:
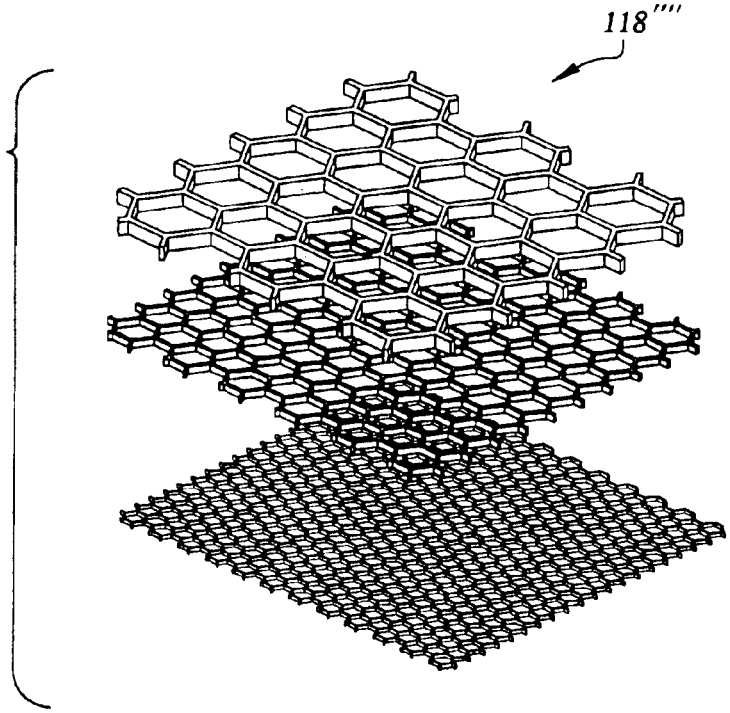

Referring to FIGS. 3 and 4, and also to FIG. 2, vapor-side bridge 118 may include one or more "fractal" layers FL, such as fractal layers FL1, FL2, FL3 shown. As used herein, the term "fractal" is a term of convenience used to indicate that the various layers FL of bridge 118 have an internal structure generally defined by openings 122 configured and arranged so as to provide the bridge with the ability to spread heat from ribs 108 as evenly as practicable over outer surface 120 of capillary wick 106, while also providing the bridge with a high permeability to vapor 112. One type of bridge 118 that satisfies these competing criteria comprises a plurality of layers FL each having openings 122 in sizes and of a number different from the sizes and numbers of the openings of the other layers FL, with the layer(s) more proximate ribs 108 having larger and fewer openings and the layer(s) more proximate outer surface 120 of capillary wick 106 having smaller and more openings.

When openings 122 in all of layers FL are the same shape as one another and are arranged in the same pattern, but the sizes of the openings decrease from layer to layer while the number of the openings increases, the openings are somewhat "fractal" in nature, i.e., their shapes and patterns are repeated at increasingly smaller scales from one layer to the next in a direction away from ribs 108. It is noted, however, that the use of the term "fractal" herein is not intended to imply that the shapes and patterns must be the same from one layer FL to the next layer, nor that there be any formal mathematical relationship among the scale factors between adjacent layers, if more than two layers are used. In addition, it is noted that although bridge 118 is shown and described as including a plurality of layers FL that are separate sheets, the layers may be present within a monolithic bridge. Furthermore, in the latter case, layers FL may not be as well defined as they are in a sheet-type embodiment. That is, the transition from larger and fewer openings 122 proximate ribs 108 to smaller and more openings proximate outer surface 120 of wick 106 may be more gradual than the discrete steps that the individual sheets provide. Those skilled in the art will appreciate that although FIGS. 2–4 illustrate vapor-side bridge 118 as having three fractal layers FL1-3, a bridge of the present invention may have more or fewer than three fractal layers depending upon the design of the particular capillary evaporator 100.

Each fractal layer FL1-3 may be formed from a sheet of metal, such as copper or aluminum, or other material having a relatively high thermal conductivity and comprises a plurality of passageways, or openings 122, extending through the sheet. Openings 122 in fractal layers FL1-3 may be provided in increasing numbers and decreasing sizes in each successive layer the closer that layer is to capillary wick 106. That is, fractal layer FL1 farthest from capillary wick 106 may have relatively few large openings 122, whereas fractal layer FL3 closest to the wick has relatively many small openings 122. Fractal layer FL2 would then have an intermediate number of intermediate sized openings 122.

Figure 1A:
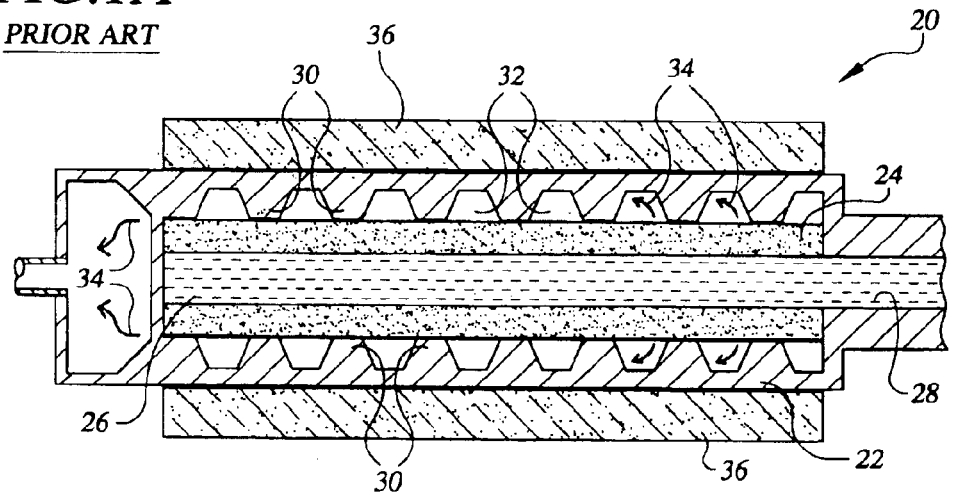
FIG.1A PRIOR ART
FIG. 1A is a longitudinal cross-sectional view of a conventional capillary evaporator.
Figure 1B:
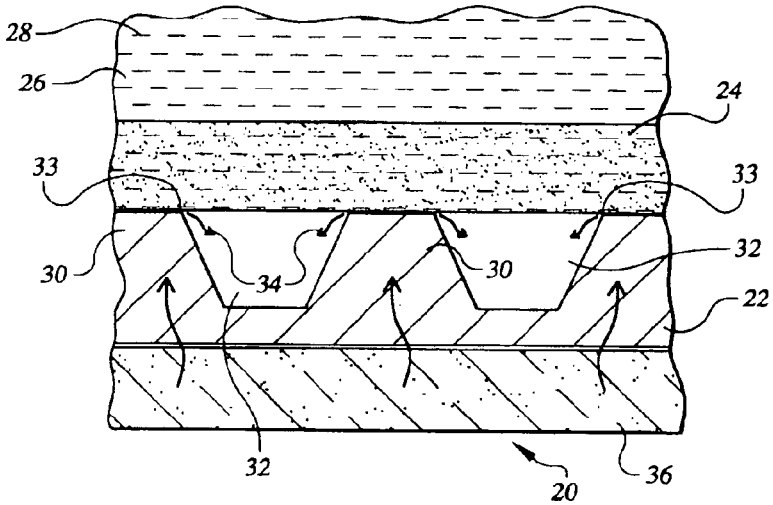
FIG.1B PRIOR ART
FIGS. 1B and 1C are enlarged cross-sectional views of the capillary wick/housing interface of the conventional capillary evaporator of FIG. 1A showing, respectively, the capillary evaporator under low and high heat-flux conditions.
Figure 1C:
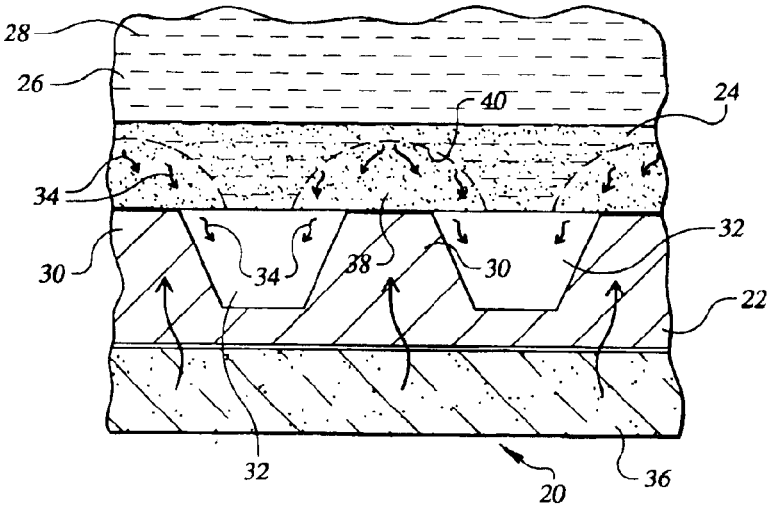
FIG.1C PRIOR ART

The configuration of fractal layers FL and arrangement of openings 122 therein provides several important advantages compared to prior art evaporator structures. As the feature size of the fractal layers FL decreases, the contact perimeter between wick 106 and bridge 118 increases many times beyond the contact perimeter between ribs 30 and wick 24 shown in FIG. 1A. Therefore, the region of evaporation is increased significantly and levels of heat-flux may be increased to values that would produce vapor penetration within prior art wicks, e.g., wick 24 as illustrated in FIG. 1C. Further, vapor-side bridge 118 is an efficient structure for creating a compromise for the competing requirements that the bridge must satisfy, conducting heat from housing 104 to capillary wick 106 and providing passageways, formed by the overlap of openings 122 in the various fractal layers FL1-3, for conducting vapor 112 away from the wick. Also, because the flow of heat is more effectively spread to all regions of wick 106 and not concentrated at locally confined regions as is so in conventional evaporators, e.g., in evaporator 20 of FIG. 1A wherein ribs 30 are in direct contact with wick 24, the material of capillary wick 106 may be thermally insulating, rather than thermally conducting, without suffering appreciable performance penalty. In this case, heat transfer to the opposite side of capillary wick 106 adjacent to liquid 114 is much decreased, and the performance limit whereby bubble boiling occurs in the liquid is eliminated.

In one particular configuration, fractal layer FL1 may be provided with square openings 122 having a pitch P1, i.e., distance from one point of an opening to the same point of an immediately adjacent opening, wherein each opening in fractal layer FL1 has a first area A1. It is noted that in the embodiment shown, pitch P1 is the pitch along two orthogonal axes 124, 126 of vapor-side bridge 118. Those skilled in the art will appreciate, however, that pitch P1 along each of axes 124, 126 (FIG. 4) may be different from one another. In addition, pitch P1 may also vary in any direction to optimize vapor-side bridge 118 for particular design conditions. If desired, pitch P1 may be equal to the pitch of ribs 108 so that webs 128 of fractal layer FL1 may confront corresponding ribs to maximize the size of the contact area between fractal layer FL1 and the ribs to maximize the conduction between the ribs and fractal layer FL1.

The size and pitch of openings 122 in each successive fractal layer FL beneath fractal layer FL1, i.e., fractal layers FL2 and FL3, respectively in the present example, may be scaled by a scale factor of less than one with respect to the immediately preceding fractal layer. For example, when the scale factor is 0.5, pitch P2 of openings 122 in fractal layer FL2 along orthogonal axes 124, 126 would be equal to one-half of pitch P1 and the lengths of the sides of the square openings would be equal to one-half the lengths of the sides of the openings in fractal layer FL1. Accordingly, fractal layer FL2 would have four times the number of openings 122 as fractal layer FL1 and twice the total perimeter length of the openings, but the total area of the openings would be the same. Similarly, fractal layer FL3 may be scaled by a factor of 0.5 with respect to fractal layer FL2, such that pitch P3 would be one-half of pitch P2 such that fractal layer FL3 would have four times the number of openings 122 as fractal layer FL2, with twice the total perimeter, but, again, the same total opening area. In addition to varying the number, pitch P1-3, and size of openings 122 from one fractal layer FL1-3 to another, the thickness of these fractal layers may also, but need not necessarily, be scaled. For example, with a scale factor of 0.5, the thickness of fractal layer FL2 may be equal to one-half the thickness of fractal layer FL1, and the thickness of fractal layer FL3 may be equal to one-half the thickness of fractal layer FL2. The following Table I illustrates the relationship between various aspects of fractal layers FL1-3 for a scale factor of 0.5 for each pair of adjacent layers.

TABLE I

| Fractal Layer | Gross Area ($cm^2$) | Number of Openings | Area of each Opening ($\mu m^2$) | Total Perimeter of Openings ($\mu m$) | Pitch ($\mu m$) | Thickness ($\mu m$) |
|---|---|---|---|---|---|---|
| FL1 | 4 | 289 | $4.9 \times 10^5$ | $8.092 \times 10^5$ | 1,200 | 500 |
| FL2 | 4 | 1,156 | $1.225 \times 10^5$ | $16.184 \times 10^5$ | 600 | 250 |
| FL3 | 4 | 4,624 | $3.0625 \times 10^4$ | $32.368 \times 10^5$ | 300 | 125 |

Vapor-side bridge 118, and therefore fractal layers FL1-3 may be made in any shape needed to conform to the shape of outer surface 120 of capillary wick 106. For example, if capillary wick 106 is planar, fractal layers FL1-3 may likewise be planar, and if the wick is cylindrical, the fractal layers may likewise be cylindrical. If vapor-side bridge 118 is a shape other than planar, such as curved or folded, pitches P1-3 of openings 122 in fractal layers FL1-3 may need to be different from the pitches that would be used for a corresponding planar bridge 106 to account for the effect of the curvature or fold and the fractal layers being different distances from the center of curvature or fold.

To improve the conduction of heat through vapor-side bridge 118, and/or create a unified structure for the bridge, fractal layers FL1-3 may, but need not necessarily, be bonded or otherwise continuously attached to one another at the regions of contact between adjacent layers, e.g., by diffusion bonding. Similarly, to improve the thermal conductance between ribs 108 and vapor side bridge 118 and/or between the bridge and capillary wick 106, the bridge may likewise be attached to one or both of the ribs and wick, e.g., by diffusion bonding or other means.

Each fractal layer FL1-3 may be fabricated using any one or more fabrication techniques known in the art to be suitable for creating openings 122 and other features of these layers. Such techniques may include the masking, patterning, and chemical etching techniques well known in the microelectronics industry and micro-machining techniques, such as mechanical machining, laser machining, and electrical discharge machining (EDM), among others, that are also well known in various industries. Since these techniques for fabricating fractal layers FL1-3 are well known in the art, they need not be described in any detail herein. Although vapor-side bridge 118 is shown in FIGS. 3 and 4 as having square openings 122, as shown in FIGS. 5A–D alternative bridges 118', 118", 118'", 118"", respectively, may have openings that are any shape desired, such as elongate rectangular (FIG. 5A), circular (FIG. 5B), triangular (FIG. 5C), or hexagonal (FIG. 5D), among others.

As can be appreciated, the geometry of vapor-side bridge 118 is extremely rich and, therefore, can be readily adapted to optimize the bridge to a particular set of operating conditions of capillary evaporator 100. This is so because vapor-side bridge 118 has associated therewith a relatively large number of variables that a designer may change in optimizing a particular design. These variables include the number of fractal layers FL, thickness of each fractal layer, sizes of openings 122, shape of each opening, pitch P of the openings, scale factor, and ratio of open area to total area, among others.

Figure 6:
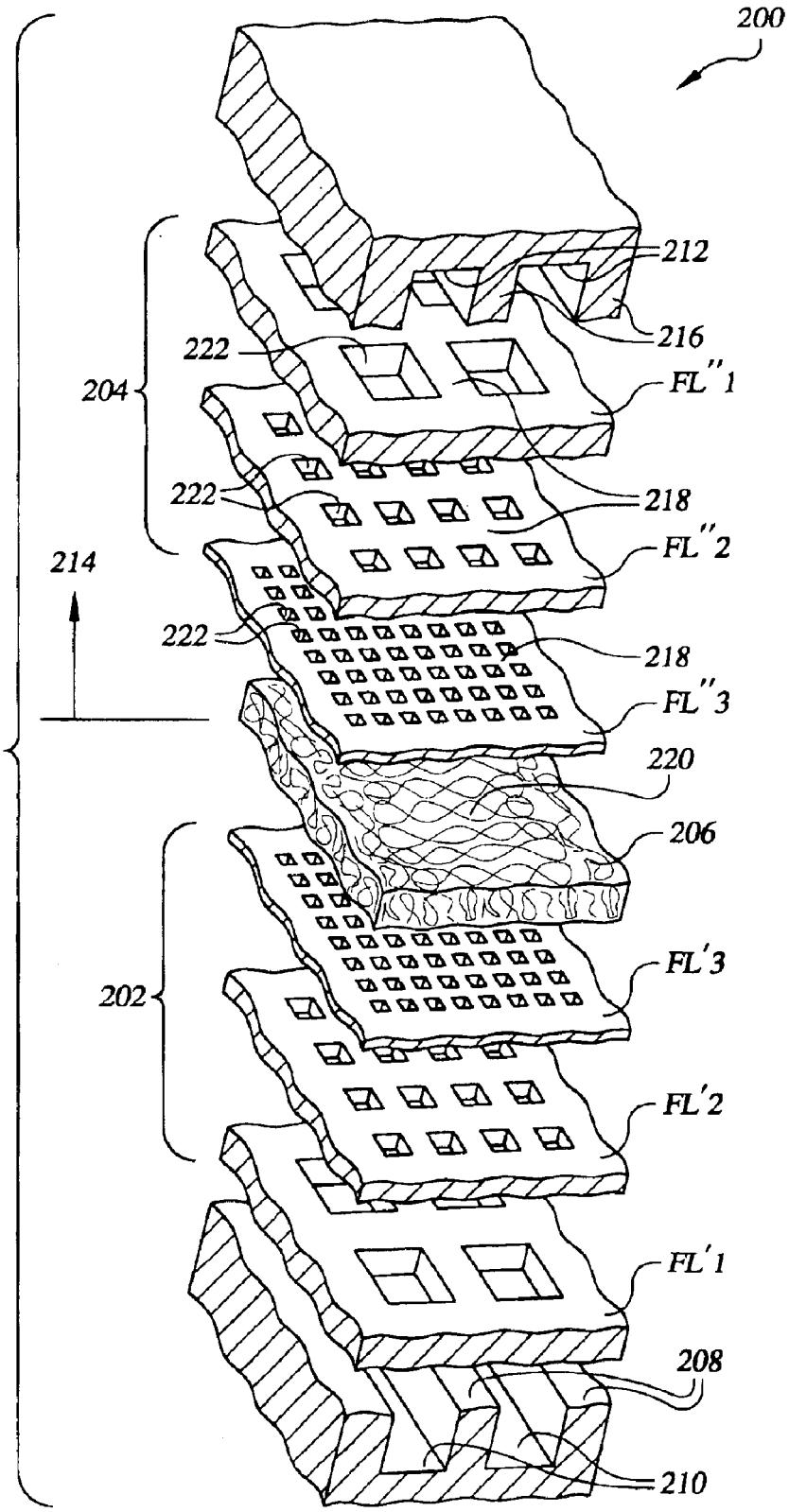
FIG. 6 is a perspective exploded partial view of a portion of an alternative capillary evaporator of the present invention having vapor-side and liquid-side bridges.

FIG. 6 illustrates an alternative capillary evaporator 200 of the present invention having both a vapor-side bridge 202 and a liquid-side bridge 204. Similar to vapor-side bridge 118 in connection with FIGS. 2–4 discussed above, vapor-side bridge 202 provides a robust structure for providing a structure between capillary wick 206 and vapor-side ribs 208 and vapor channels 210 that has great ability to spread heat from ribs to the wick, but also has a high permeability to allow vapor (not shown) to flow from the wick to the vapor channels. In the embodiment shown, vapor-side bridge 202 has three fractal layers FL'1–3 similar to fractal layers FL1–3 described above with respect to bridge 118 of FIGS. 2–4. Of course, as discussed above, bridge 202 may have any number of fractal layers FL' desired and may have any structure suitable for providing a compromise to the competing criteria of high permeability and high heat spreading capability.

Liquid-side bridge 204 provides advantages similar to vapor-side bridge 202. That is, liquid-side bridge 204 provides a structure that substantially uniformly cools capillary wick 206 while providing a highly permeable structure that allows liquid (not shown) from liquid channels 212 to flow substantially uniformly across the wick. Cooling of capillary wick 206 is often desired so as to inhibit boiling of the liquid on liquid side 214 of capillary evaporator 200, a condition that is highly destructive to the cooling capabilities of the capillary evaporator. When liquid-side bridge 204 is made of a material having a high thermal conductivity, such as metal, among others, the liquid-side bridge provides this cooling capability, in part, by virtue of the fact that the region of the liquid-side bridge most distal from capillary wick 206 may contact the relatively cool ribs 216, which are cooled by the flow of the cool liquid flowing through liquid channels 212, e.g., from a condenser (not shown). This region of liquid-side bridge 204 is also immersed in the relatively cool liquid flowing from liquid channels 212. Thus, when liquid-side bridge 204 is thermally conductive, the solid portions 218 of layers FL"1–3 "spread the coolness" from ribs 216 and the liquid in liquid channels 212 over the liquid-side surface 220 of capillary wick 206.

Like vapor-side bridges 202, 118 (FIGS. 2–4), liquid-side bridge 204 provides this spreading capability by virtue of its internal features, e.g., openings 222, decreasing in size while increasing in number from one layer FL" to the next in a direction away from ribs 216. It is this same structure that provides liquid-side bridge 204 with its relatively high permeability and ability to spread the liquid from liquid channels 212 across the liquid-side surface 220 of capillary wick 206. Similar to vapor-side bridge 202, while liquid side bridge is shown as comprising three fractal layers FL"1–3, those skilled in the art will readily appreciate that liquid-side bridge may, too, have more or fewer layers and may have any structure suitable for providing high-permeability, high liquid spreadability, and high "coolness spreadability."

Experimental Results:

To illustrate the effect of the bridge of the present invention on the performance of a capillary evaporator of the present invention, the inventor fabricated four evaporators that were identical to one another, except for the number of fractal layers. One of the evaporators had no bridge whatsoever, and the other three evaporators each had both a vapor-side bridge and a liquid-side bridge, both of which had 1, 2, or 3 fractal layers each. These four evaporators are designated Fractal 0, Fractal 1, Fractal 2, and Fractal 3, which indicate the number of fractal layers in each of vapor-side and liquid-side bridges of that evaporator, if any.

Figure 7:
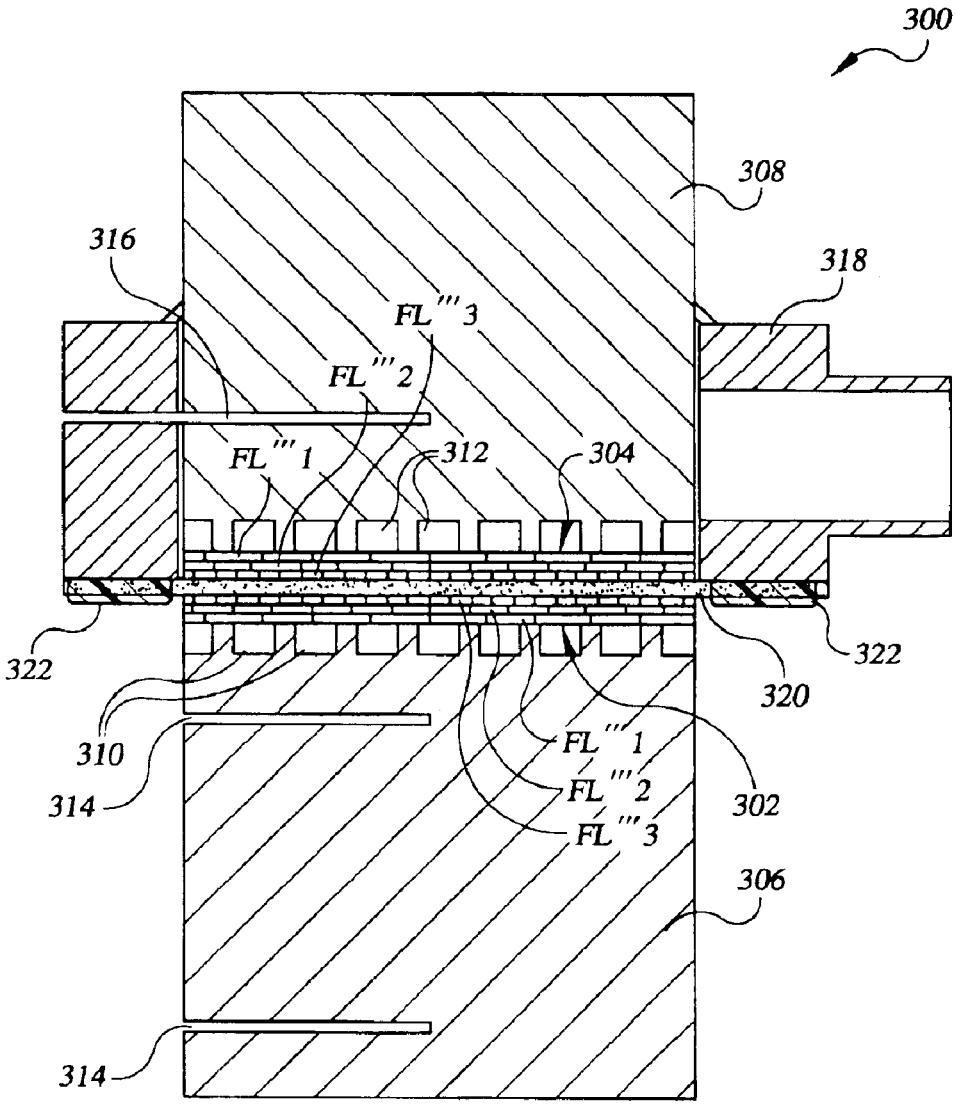
FIG. 7 is an elevational cross-sectional view of one of four test evaporators used to conduct experiments to quantify operating performance of various capillary evaporators made in accordance with the present invention.

FIG. 7 shows one of these four evaporators, which are generically referred to as evaporator 300 in the following discussion, i.e., the Fractal 3 evaporator that has all three fractal layers FL'"1–3 in each of its vapor-side and liquid-side bridges 302, 304. Fractal 2 evaporator (not shown) included only fractal layers FL'"2 and FL'"1 in each of its vapor-side and liquid-side bridges, and Fractal 1 evaporator (not shown) included only fractal layer FL'"1 in each of its vapor-side and liquid-side bridges. Fractal 0 evaporator (not shown) included no fractal layers and had only the wick 320 separating the liquid and vapor sides of the evaporator. Each fractal layer FL'"1–3 was photoetched out of a copper sheet, and where two or more fractal layers were present, they were diffusion bonded together. Tables II and III show the nominal and actual pitches, thickness, and area of openings for each of the three fractal layers. The pitch and thickness scale by a factor of 0.5, but due to variations in the etching process, the dimensions of opening are not quite to scale. It is noted that no attempt was made to optimize fractal layers FL'"1–3. Even so, the results obtained well-illustrate the benefits of bridges 302, 304 provided by their robust, unique structure.

TABLE II

Nominal Dimensions

| Fractal Layer | Opening Diameter (μm) | Pitch (μm) | Thickness (μm) |
|---|---|---|---|
| FL'"1 | 700 | 1,200 | 500 |
| FL'"2 | 350 | 600 | 250 |
| FL'"3 | 175 | 300 | 125 |

TABLE III

Actual Dimensions

| Fractal Layer | Opening Diameter (μm) | Pitch (μm) | Thickness (μm) |
|---|---|---|---|
| FL'"1 | 632 | 1,199 | 508 |
| FL'"2 | 308 | 600 | 254 |
| FL'"3 | 221 | 300 | 125 |

Each bridge 302, 304, where present, was diffusion bonded to a corresponding relatively thick copper slug 306, 308 having either vapor manifold channels 310 or liquid manifold channels 312 machined into it. Vapor-side and liquid-side copper slugs 306, 308 also had machined therein two thermocouple ports 314 and one thermocouple port 316, respectively. The vapor-side and liquid-side assemblies each had a transverse cross-sectional area of 1 $cm^2$. Liquid-side slug 308 was soldered to a sleeve/fitting assembly 318 for supplying liquid manifold channels 312 with the working liquid. A 275 μm thick glass fiber capillary wick 320 having a capillary head of 1 m of water was bonded to sleeve/fitting assembly 318 with an epoxy 322.

It is noted that glass fiber capillary wick 320 was flexible but well supported on both of its planar faces by bridges 302, 304. As should be readily apparent, the continuity of the support from bridges 302, 304 becomes greater with the increasing number of fractal layers FL'", which translates into a smaller pitch for the openings in the fractal layers immediately adjacent to capillary wick 320, in the present case fractal layers FL'"3 of the two bridges.

Figure 8:
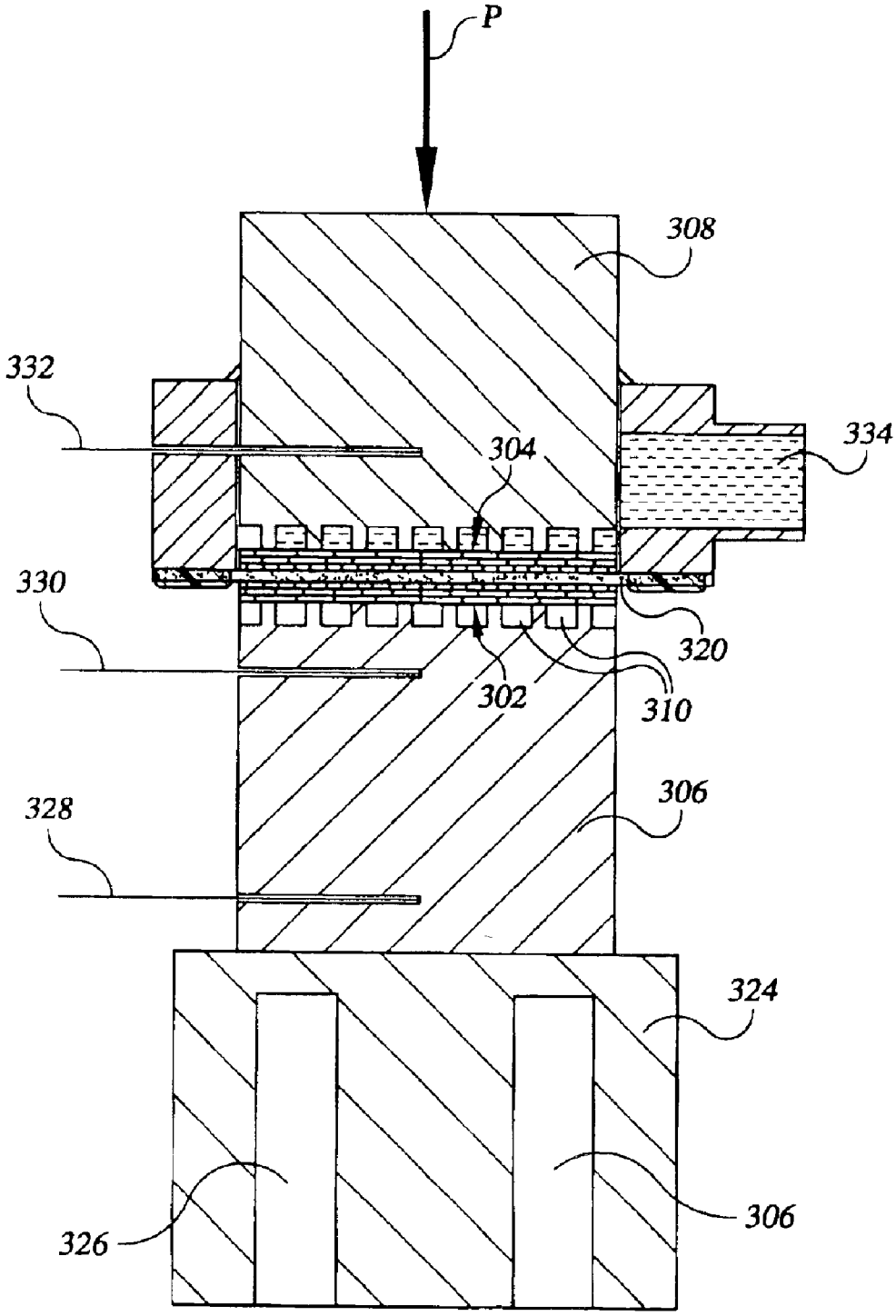
FIG. 8 is an elevational cross-sectional view of the test evaporator of FIG. 7 mounted in a testing apparatus.

As illustrated by FIG. 8, each vapor-side slug 306 was soldered to a corresponding large copper block 324 containing four 200 W cartridge heaters 326. The liquid-side assembly was then placed over the vapor-side assembly and held tightly thereagainst by applying a vertical load P to liquid-side slug 308. Care was taken to maintain alignment between the vapor- and liquid-side bridges 302, 304 during testing.

Three thermocouples 328, 330, 332 were used to measure various temperatures of the evaporators 300 during the tests.

Thermocouples 328, 330 were placed on the vapor side to calculate the heat flux into evaporator 300. The temperature of vapor-side copper block 306 1 mm below the base of vapor manifold channels 310 was then obtained by subtracting from the upper thermocouple 330 temperature the calculated conduction temperature drop. The difference between the temperature 1 mm below the base of vapor manifold channels 310 and the vapor saturation temperature was used to calculate the thermal resistance of evaporator 300.

Room temperature, degassed water 334 was supplied to the liquid side of the evaporator from a 0.5 L flask (not shown). An air ejector (not shown) maintained a constant suction on the flask of 10 cm $H_2O$ throughout the tests. The flask was placed on an electronic scale (not shown) to allow real-time recording of its weight during the test. The water consumption rate was used to provide a verification of the heat flux measurement obtained from the thermocouple readings. The data from all the instruments (not shown) was recorded using a computer-based data acquisition system.

Figure 9A:
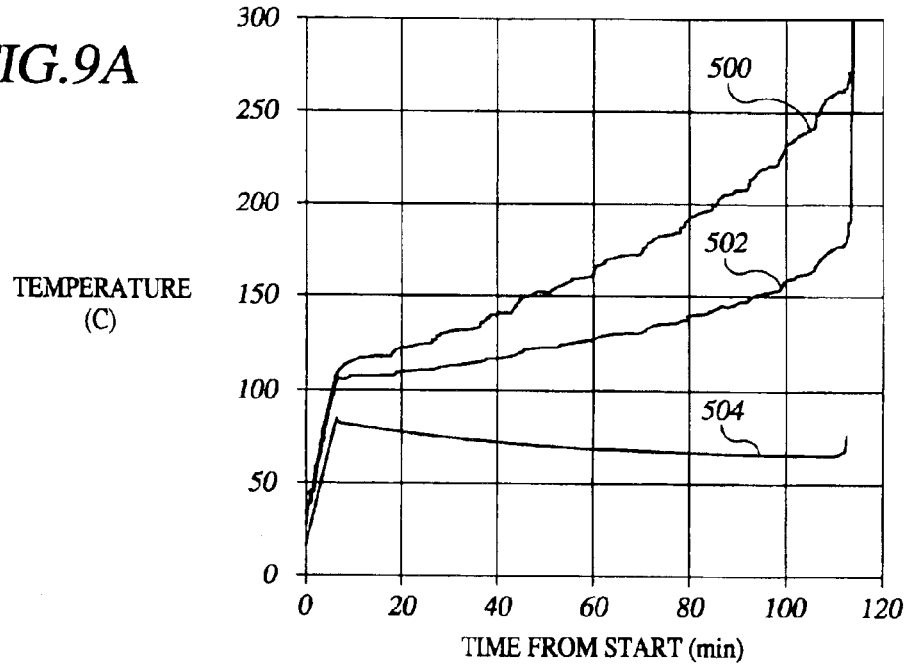
FIGS. 9A and 9B show, respectively, a typical temperature versus time trace for one of the test evaporators and the corresponding curve of thermal resistance versus heat flux.
Figure 9B:
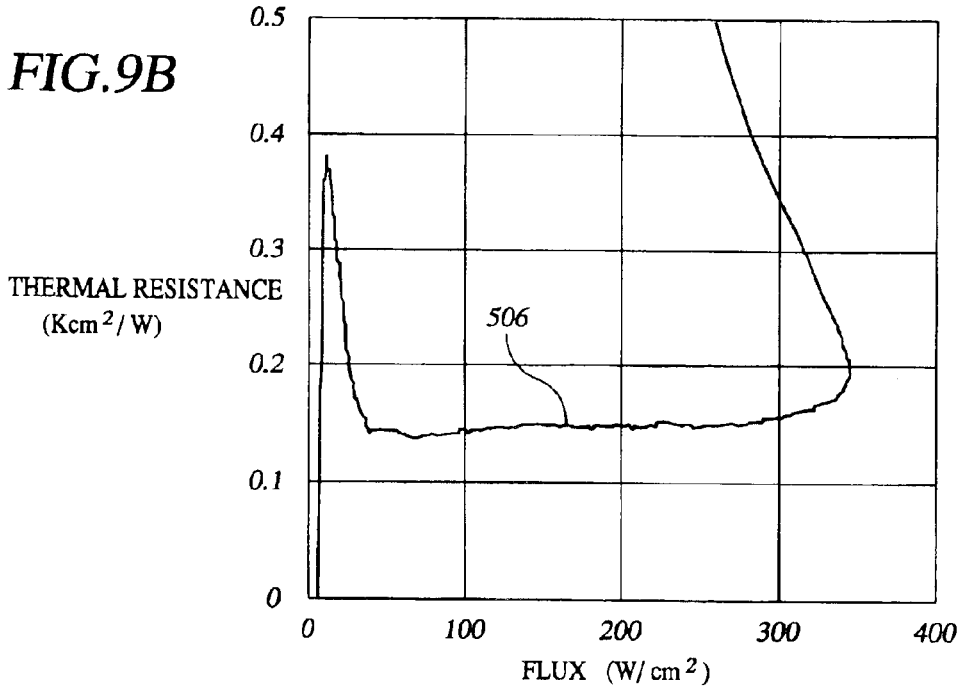
Figure 10A:
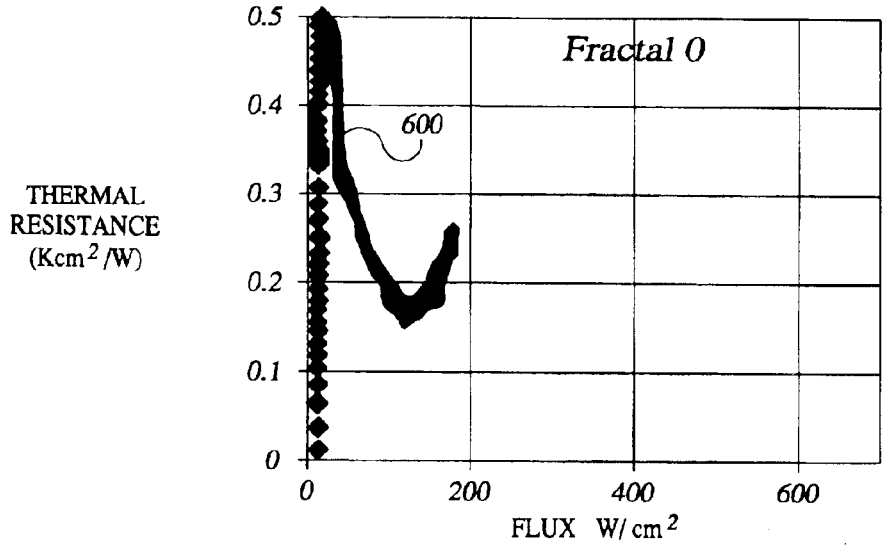
FIGS. 10A–10D are graphs of thermal resistance versus heat flux for, respectively, each of four test evaporators.
Figure 10B:
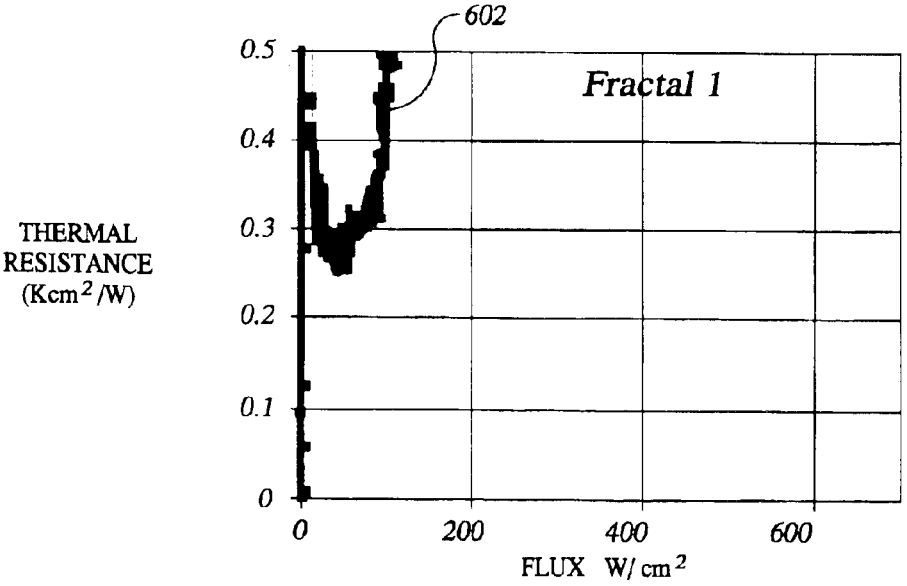
Figure 10C:
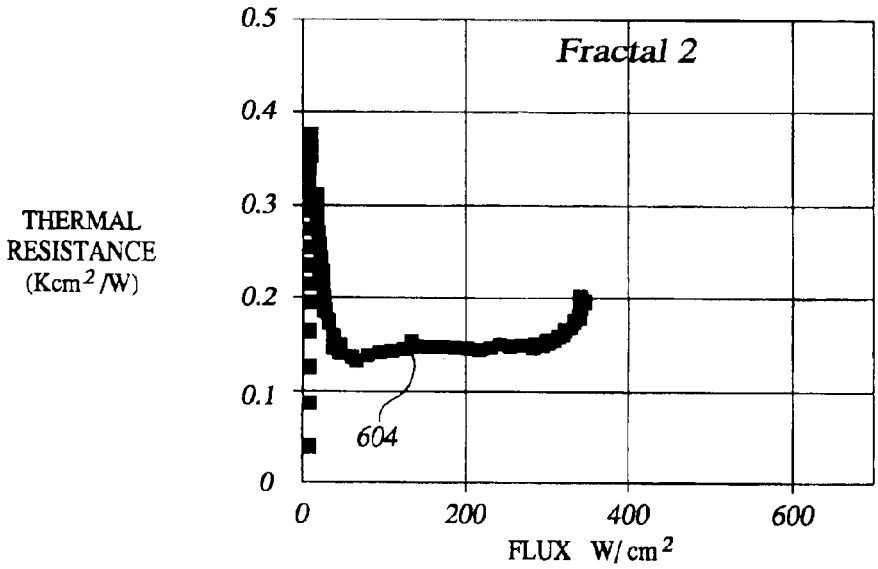
Figure 10D:
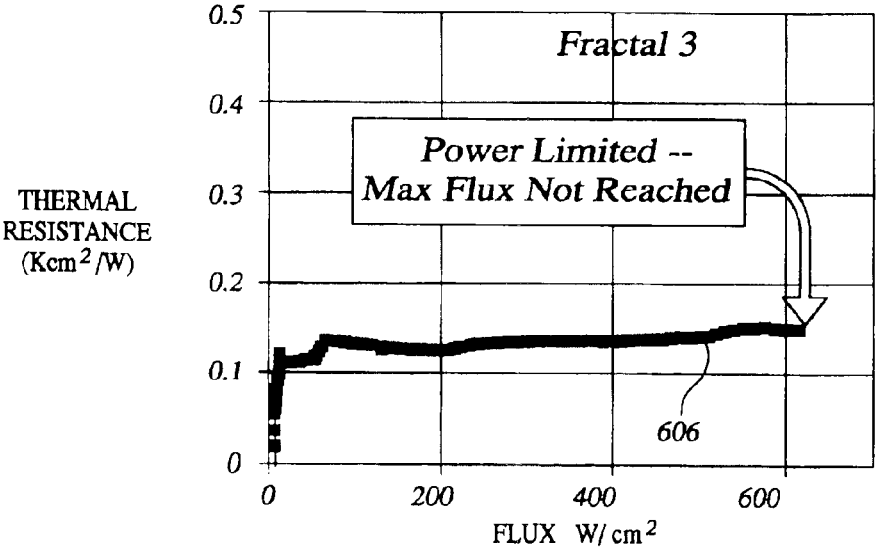

Referring to FIGS. 9A and 9B, and also to FIGS. 7 and 8, FIGS. 9A and 9B show, respectively, typical temperature traces 500, 502, 504 for thermocouples 328, 330, 332, respectively, and a corresponding thermal resistance versus heat flux curve 506 obtained during the tests. These results shown are for the Fractal 2 evaporator 300 having two fractal layers (FL'''1, FL'''2) in each of its vapor-side and liquid-side bridges 302, 304. Since the area of evaporator 300 was 1 $cm^2$, the heat flux also represents the actual heat input to the evaporator. As shown by FIG. 9A, at the beginning of the test all thermocouples 328, 330, 332 were at room temperature. As heat was applied, temperature traces 500, 502, 503 showed all three thermocouples 328, 330, 332 heated up rapidly. Vapor-side thermocouples 328, 330, i.e., traces 500, 502, showed little difference in temperature, but liquid-side thermocouple 332, trace 504, lagged behind because heat had to be conducted through low thermally conductive capillary wick 320 to heat up the liquid side of evaporator 300. When the temperature at the top of vapor-side bridge 302 reached the saturation temperature, evaporation started taking place and the temperatures of vapor-side thermocouples 328, 330 started to diverge, indicating heat was being absorbed by the evaporation of liquid 334 within evaporator 300. Temperature traces 500, 502 showed that the vapor-side temperatures continued to increase as the heat flux was gradually increased, until dryout point of capillary wick 320 was reached. Temperature trace 504 showed that the liquid-side temperature reached a maximum of about 90° C. during startup and then decreased as the increased heat flux caused an increased flow of room-temperature liquid into evaporator 300.

FIG. 9B shows the calculated thermal resistance curve 506 for evaporator 300 as a function of heat flux for the same test of the Fractal 2 evaporator 300. Curve 506 was produced real-time as the test progressed. After an initial start-up transient, the thermal resistance settled to about 0.14 K/(W/$cm^2$) and remained fairly constant up to a heat flux of about 300 W/$cm^2$. This is an indication that up to that extremely high value of heat flux, the Fractal 2 evaporator 300 was operating with capillary wick 320 fully-wetted. As the heat flux approached 350 W/$cm^2$, the thermal resistance increased rapidly, indicating incipient dryout of capillary wick 320. Following dryout, evaporator 300 lost its ability to transport liquid 330 into the wick, heat absorption by evaporation of the liquid cannot take place, and the temperatures within the evaporator increased rapidly.

Referring now to FIGS. 10A–D, and also to FIGS. 7 and 8, FIGS. 10A–D are thermal resistance vs. heat flux curves 600, 602, 604, 606 for the Fractal 0, Fractal 1, Fractal 2, and Fractal 3 evaporators 300, respectively. These results show that a capillary evaporator of the present invention has a remarkable maximum heat flux capability. For example, toward the end of the tests for Fractal 3 evaporator 300, as indicated by curve 606 in FIG. 10D, cartridge heaters 326 were operating at full power, and the copper structure 324 where the cartridge heaters were installed glowed red-hot under its mineral wool insulation. Yet, cartridge heaters 326 did not have sufficient power to cause the Fractal 3 evaporator 300 to dry out. The test ended when all water in the flask that supplied water 334 to the capillary evaporator was consumed. Even Fractal 1 evaporator 300, which had the lowest opening perimeter per unit area, withstood a maximum heat flux in excess of 100 W/$cm^2$. It is noted that these are not just localized hot spots, but rather average heat fluxes over the entire cross-sectional area of evaporator 300.

It is noted that Fractal 0 evaporator 300, i.e., the test evaporator without vapor-side and liquid-side bridges 302, 304, performed slightly better than the Fractal 1 evaporator that had one bridge. Generally this is so because fractal layer FL'''1 of Fractal 1 evaporator 300 had a perimeter-to-area ratio smaller than the perimeter-to-area ratio of vapor manifold channels 310 of the Fractal 0 evaporator. That fractal layer FL'''1 had a perimeter-to-area ratio smaller than the perimeter-to-area ratio of vapor manifold channels 310 was not intended. Rather, the openings in fractal layer FL'''1 being smaller than designed was due to the relatively large tolerances of the chemical etching process used to form the openings. As those skilled in the art will appreciate, if the perimeter-to-area ratio of fractal layer FL'''1 were made larger than the perimeter-to-area ratio of vapor manifold channels 310, e.g., by increasing the size of the openings in fractal layer FL'''1, then Fractal 1 evaporator 300 would outperform the Fractal 0 evaporator.

Figure 11:
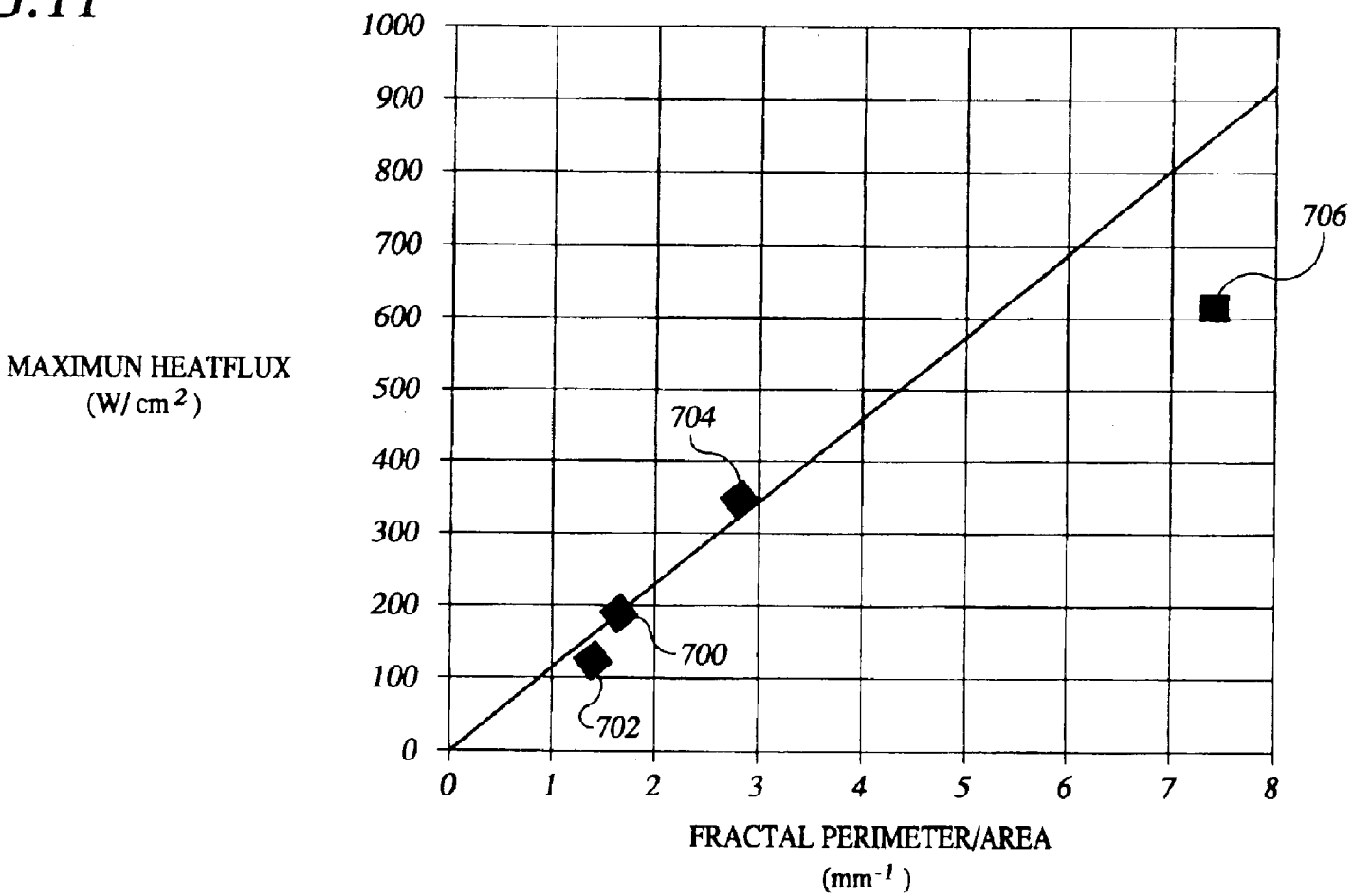
FIG. 11 is a graph of maximum measured heat flux versus the opening perimeter per unit area for the four test evaporators.

FIG. 11 shows the maximum measured heat flux value 700, 702, 704, 706 for each of the Fractal 0, Fractal 1, Fractal 2, and Fractal 3 test evaporators 300, respectively, as a function of the opening perimeter-to-area ratio, i.e., the total of the perimeters of openings of the fractal layer, i.e., fractal layer FL'''1, FL'''2, or FL'''3 depending upon the evaporator, most proximate to capillary wick 320 divided by the footprint of that fractal layer. For Fractal 0, Fractal 1, and Fractal 2 evaporators 300, these values 700, 702, 704 also correspond to the heat flux that caused a dryout condition in capillary wick 320. Again, it is noted that the non-optimally executed fractal layer FL'''1 led to Fractal 0 evaporator 300 having a higher maximum heat flux than the Fractal 1 evaporator. Had fractal layer FL'''1 been more optimally executed, Fractal 1 evaporator 300 would have outperformed the Fractal 0 evaporator. For Fractal 3 evaporator, the dryout heat flux should be substantially larger than the 620 W/$cm^2$ value 706 measured, since at the end of the tests the thermal resistance was not showing any signs that capillary wick 320 was near its dryout heat flux.

From these results, it may be observed that the dryout heat flux varies linearly with the fractal opening perimeter per unit area. This observation agrees with the qualitative description in the background section, above, in connection with FIGS. 1A–C, that most of the evaporation in evaporator 20 takes place in very small regions near the contact areas between ribs 30 and capillary wick 24. Clearly, at some point this approximation will no longer hold, since the dryout heat flux cannot increase indefinitely. However, the measured permeability and capillary head of capillary wick 320 used in the Fractal 3 evaporator suggest that in an ideal evaporator the wick used for capillary wick 320 could support a heat flux of about 4,000 W/cm$^2$. Therefore, the addition of one or more additional fractal layers to fractal layers FL'"1–3 of Fractal 3 evaporator 300 would continue to yield increases in dryout heat flux that may result in nearly approaching the 4,000 W/cm$^2$ maximum heat flux of the corresponding ideal evaporator.

The thermal resistance of a capillary evaporator of the present invention can also be remarkably low. For example, Fractal 3 evaporator 300 had a thermal resistance of only 0.13° C./(W/cm$^2$). This value is about a factor of two lower than found in surface-wick evaporators of conventional heat pipes and an order of magnitude, or more, lower than the thermal resistances of current LHP and CPL evaporators. Generally, the addition of a vapor-side bridge, e.g., bridge 302, introduces additional heat-conduction resistance. However, the present results show that the decrease in evaporation resistance at the capillary wick, e.g., capillary wick 320, due to the addition of a vapor-side bridge more than compensates for the increase in heat-conduction resistance caused by the addition of this bridge.

While the present invention has been described in connection with a preferred embodiment, it will be understood that it is not so limited. On the contrary, it is intended to cover all alternatives, modifications, and equivalents as may be included within the spirit and scope of the invention as defined above and in the claims appended hereto.

What is claimed is:

1. A capillary evaporator, comprising:

a) at least one first rib defining at least one first channel;

b) a capillary wick confronting, and spaced from, said at least one first rib; and c) a first bridge located between said at least one first rib and said capillary wick and providing fluid communication between said capillary wick and said at least one first channel and thermal communication between said capillary wick and said at least one first rib, said first bridge including a plurality of internal passageways each having a cross-sectional flow area that decreases in a direction from said at least one first rib to said capillary wick.

2. A capillary evaporator according to claim 1, wherein said at least one first channel is a vapor-side channel.

3. A capillary evaporator according to claim 1, wherein said at least one first channel is a liquid-side channel.

4. A capillary evaporator according to claim 1, wherein said first bridge comprises a plurality of layers each having a plurality of openings such that each of said plurality of layers has a different number of said plurality of openings so as to define said plurality of passageways, wherein said different numbers of said plurality of openings increase with increasing distance of said plurality of layers from said at least one rib.

5. A capillary evaporator according to claim 4, wherein said first bridge comprises a plurality of sheets corresponding to said plurality of layers.

6. A capillary evaporator according to claim 5, wherein each of said plurality of sheets is a solid body having corresponding ones of said plurality of openings formed therein.

7. A capillary evaporator according to claim 4, wherein each of said pluralities of openings have the same shapes as one another.

8. A capillary evaporator according to claim 7, wherein each of said pluralities of openings is polygonal.

9. A capillary evaporator according to claim 8, wherein each of said pluralities of openings is rectangular.

10. A capillary evaporator according to claim 7, wherein each of said pluralities of openings is circular.

11. A capillary evaporator according to claim 4, wherein said plurality of openings in each of said plurality of layers has a pitch, said pitches decreasing with increasing distance of the corresponding ones of said plurality of layers from said at least one first rib.

12. A capillary evaporator according to claim 4, wherein each of said plurality of layers has a thickness, said thicknesses decreasing with increasing distance of the corresponding ones of said plurality of layers from said at least one first rib.

13. A capillary evaporator according to claim 1, wherein said capillary wick has a first face confronting said first bridge and a second face spaced from said first face, the capillary evaporator further comprising a second bridge confronting said second face of said capillary wick, said second bridge including internal features having sizes that increase in a direction away from said capillary wick.

14. A capillary evaporator according to claim 13, further comprising at least one second rib defining at least one second channel, each of which confronts said second bridge opposite said capillary wick.

15. A capillary evaporator, comprising:

a) at least one rib defining at least one channel;

b) a capillary wick confronting, and spaced from, said at least one rib; and c) a bridge located, and providing thermal communication, between said at least one rib and said capillary wick, said bridge having:

i) a first region located proximate said at least one rib;

ii) a second region spaced from said first region and located proximate said capillary wick; and iii) a plurality of internal passageways each having a cross-sectional area, wherein said plurality of internal passageways become more numerous from said first region to said second region and said cross-sectional areas of said plurality of passageways become smaller from said first region to said second region.

16. A capillary evaporator according to claim 15, wherein said bridge comprises a plurality of layers each having a plurality of openings such that each of said plurality of layers has a different number of said plurality of openings so as to define said plurality of passageways, wherein said different numbers of said plurality of openings increase with increasing distance of said plurality of layers from said at least one rib.

17. A capillary evaporator according to claim 16, wherein said bridge comprises a plurality of sheets corresponding to said plurality of layers.

18. A capillary evaporator according to claim 17, wherein each sheet is a solid body having corresponding ones of said plurality of openings formed therein.

19. A capillary evaporator, comprising:

a) a structure having at least one rib defining at least one channel;

b) a capillary wick spaced from said at least one rib; and c) a bridge located between, and in thermal communication with, said capillary wick and said at least one rib and providing fluid communication between said capillary wick and said at least one channel, said bridge comprising a plurality of layers each including a number of openings each having an am, wherein said number of openings increases with increasing distance of corresponding ones of said plurality of layers from said at least one rib and said areas of said openings in each of said plurality of layers decrease with increasing distance of corresponding ones of said plurality of layers from said at least one rib.

20. A capillary evaporator according to claim 19, wherein said bridge comprises a plurality of sheets corresponding to said plurality of layers.

21. A capillary evaporator according to claim 20, wherein said plurality of sheets are diffusion bonded to one another.

22. A capillary evaporator according to claim 20, wherein each sheet is a solid body having corresponding ones of said plurality of openings formed therein.

23. A system, comprising:

a) a capillary evaporator, comprising:

i) at least one rib defining at least one channel;

ii) a capillary wick confronting and spaced from, said at least one rib; and iii) a bridge located between said at least one rib and said capillary wick and providing fluid communication between said capillary wick and said at least one channel and thermal communication between said capillary wick and said at least one first rib, said bridge including a plurality of passageway each having a cross-sectional flow area that decreases from said at least one rib to said capillary wick; and b) a heat source in thermal communication With said at least one rib.

24. A system according to claim 23, wherein said heat source comprises a microprocessor.

25. A system according to claim 23, wherein said heat source comprises at least one of a laser and a laser diode array.

26. A method of forming a bridge for a capillary evaporator having a capillary wick and at least one rib, comprising the steps of:

a) providing a plurality of sheets each having openings of different number and different sizes such that the one of said plurality of sheets having the largest of said different sizes of said openings has the least of said different number of said openings and the one of said plurality of sheets having the smallest of said different sizes of said openings baa the most of said different number or said openings;

b) locating said plurality of sheets between the capillary wick and the at least one rib such that the one of said plurality of sheets having the smallest ones of said openings is proximate the wick and the one of maid plurality of sheets having the largest ones of said openings is proximate said at least one rib.

27. A method according to claim 26, wherein step a includes forming said openings in each of said plurality of sheets.

28. A method according to claim 27, wherein the step of forming said openings includes etching.

29. A method according to claim 27, wherein the step of forming said openings includes machining.

30. A method according to claim 29, wherein said machining includes laser machining.

31. A method according to claim 29, wherein said machining includes electrical discharge machining.

32. A method according to claim 29, wherein said machining includes mechanical machining.

33. A method according to claim 26, further comprising the step of bonding said plurality of sheets to one another.

34. A method according to claim 26, further comprising the step of bonding the bridge to the at least one rib.

* * * * *

UNITED STATES PATENT AND TRADEMARK OFFICE

CERTIFICATE OF CORRECTION

PATENT NO. : 6,863,117 B2
DATED : March 8, 2005
INVENTOR(S) : Javier A. Valenzuela It is certified that error appears in the above-identified patent and that said Letters Patent is hereby corrected as shown below:

Column 14,
Line 62, “am,” should be -- area, --

Column 15,
Line 21, “passageway” should be -- passageways --

Column 16,
Line 12, “maid” should be -- said --

Signed and Sealed this

Seventeenth Day of May, 2005

JON W. DUDAS
*Director of the United States Patent and Trademark Office*

UNITED STATES PATENT AND TRADEMARK OFFICE

CERTIFICATE OF CORRECTION

PATENT NO. : 6,863,117 B2
DATED : March 8, 2005
INVENTOR(S) : Javier A. Valenzuela It is certified that error appears in the above-identified patent and that said Letters Patent is hereby corrected as shown below:

Column 1,
Line 2, add the following:
-- GOVERNMENT SUPPORT
This invention was made with Government support under Contract No. NAS5-01181 awarded by NASA. The Government has certain rights in the invention. --.

Signed and Sealed this

Eleventh Day of October, 2005

JON W. DUDAS
*Director of the United States Patent and Trademark Office*